United States Patent [19]

Flanagan

[11] 4,417,930

[45] Nov. 29, 1983

[54] ELECTROPHILIC SOLID PROPELLANT GAS GENERATOR

[75] Inventor: Joseph E. Flanagan, Woodland Hills, Calif.

[73] Assignee: Rockwell International Corporation, El Segundo, Calif.

[21] Appl. No.: 779,882

[22] Filed: Mar. 16, 1977

[51] Int. Cl.[3] ..... C06B 45/10

[52] U.S. Cl. ..... 149/19.9; 149/76; 149/119

[58] Field of Search ..... 149/19.9, 87, 80, 81, 149/76, 119

[56] References Cited

U.S. PATENT DOCUMENTS

| | | | |
|---|---|---|---|
| 2,995,526 | 8/1961 | DeMent | 149/81 |
| 3,383,860 | 5/1968 | Sayles | 149/19.9 |
| 3,802,971 | 4/1974 | Burkardt et al. | 149/19.9 |
| 3,821,042 | 6/1974 | Cutforth et al. | 149/19.9 |
| 3,839,105 | 10/1974 | Dewitt et al. | 149/19.9 |

OTHER PUBLICATIONS

Bailar, "Comprehensive Inorganic Chemistry", vol. 2, 1378–1380, Pergamon Press (1973) Oxford.

*Primary Examiner*—Edward A. Miller

*Attorney, Agent, or Firm*—H. Fredrick Hamann; Harry B. Field

[57] ABSTRACT

An electrophilic solid propellant gas generator employing iodine pentoxide ($I_2O_5$) as a prime oxidizer which produces high concentrations of iodine atoms.

2 Claims, No Drawings

ELECTROPHILIC SOLID PROPELLANT GAS GENERATOR

BACKGROUND OF THE INVENTION

1. Field of the Invention

This invention relates to compositions of matter and is particularly directed to compositions of matter for use as electrophilic solid propellant gas generator. Specific compositions are described which provide iodine atoms in the exhaust which are capable of quenching electrons generated by solid objects passing through a gaseous media at high velocities and temperatures.

2. Description of the Prior Art

Solid propellant gas generators have become widely used for a multiplicity of purposes and several types of solid propellant gas generators have been designed for quenching electrons. Specifically, solid propellants heavily loaded with tungsten, molybdenum, rhenium or vanadium metal and oxidized with ammonium perchlorate generate gaseous metal-oxide-hydroxide products which are capable of attaching electrons. A typical example could be derived from tungsten in which case the electrophilic species is $H_2WO_4$ gas.

Unfortunately, as the temperature of the gaseous media containing the undesirable electrons is raised above 2500° K., the ability of the metal-oxide-hydroxide compounds to attach the electrons is severely degraded.

BRIEF SUMMARY AND OBJECTS OF THE INVENTION

The disadvantages of the prior art are overcome with the present invention and a family of solid propellant gas generators is proposed which provide electrophilic species which are stable for electron attachment at temperatures above 2500° K. Additionally, the density of the proposed solid propellants is greater than prior art thereby allowing superior packaging characteristics.

The advantages of the present invention are preferably attained by providing solid propellant gas generator formulations employing iodine pentoxide ($I_2O_5$) as an oxidizer.

Accordingly, it is an object of the present invention to provide improved electrophilic solid propellant gas generators.

Another object of the present invention is to provide solid propellant gas generators whose exhaust species will attach electrons at temperatures above 2500° K.

A specific object of the present invention is to provide solid propellant gas generator formulations employing iodine pentoxide ($I_2O_5$) as an oxidizer.

DETAILED DESCRIPTION OF THE INVENTION

In that form of the present invention chosen for purposes of illustration, a solid propellant gas generator system is proposed comprising iodine pentoxide as the prime oxidizer, ammonium perchlorate (AP) as a secondary oxidizer, and hydroxy-terminated polybutadiene as a fuel and binder.

EXAMPLE I

A solid propellant containing 70 percent by weight of $I_2O_5$ (5μ particle size), 15 percent by weight AP (25μ particle size) and 15 percent by weight hydroxy-terminated polybutadiene yielded 0.194 gram moles of iodine atoms/100 grams of propellant. This propellant had a density of 2.688 gm/cm$^3$ and a burn rate of 0.20 inches/second at 1000 psi.

EXAMPLE II

A solid propellant containing 70 percent by weight of $I_2O_5$ (25μ particle size), 15 percent by weight AP (25μ particle size) and 15 percent by weight hydroxy-terminated polybutadiene yielded 0.194 gram moles of iodine atoms/100 grams of propellant. This propellant had a density of 2.688 gm/cm$^3$ and a burn rate of 0.15 inches/second at 1000 psi.

EXAMPLE III

A solid propellant containing 70 percent by weight of $I_2O_5$ (25μ particle size), 15 percent by weight AP (1μ particle size) and 15 percent by weight hydroxy-terminated polybutadiene yielded 0.194 gram moles of iodine atoms/100 grams of propellant. This propellant had a density of 2.688 gm/cm$^3$ and a burn rate of 0.40 inches/second at 1000 psi.

I claim:

1. A solid propellant iodine atom gas generator system comprising:

iodine pentoxide as an iodine-containing primary oxidizer, ammonium perchlorate as a secondary oxidizer, hydroxy-terminated polybutadiene as the binder and fuel.

2. A solid propellant iodine atom gas generator system consisting of:

| | |
|---|---|
| iodine pentoxide | 60–80 percent |
| ammonium perchlorate | 5–20 percent |
| hydroxy-terminated polybutadiene | 10–20 percent |

* * * * *